US006530639B1

(12) United States Patent
Matsuda

(10) Patent No.: US 6,530,639 B1
(45) Date of Patent: Mar. 11, 2003

(54) IMAGE FORMING DEVICE

(75) Inventor: Yuji Matsuda, Tokyo (JP)

(73) Assignee: Copyer Co., Ltd., Tokyo (JP)

( * ) Notice: Subject to any disclaimer, the term of this patent is extended or adjusted under 35 U.S.C. 154(b) by 0 days.

(21) Appl. No.: 10/018,848

(22) PCT Filed: Jun. 26, 2000

(86) PCT No.: PCT/JP00/04178

§ 371 (c)(1),
(2), (4) Date: Dec. 17, 2001

(87) PCT Pub. No.: WO01/00414

PCT Pub. Date: Jan. 4, 2001

(30) Foreign Application Priority Data

Jun. 24, 1999 (JP) ..... 11-177862

(51) Int. Cl.[7] ..... B41J 2/205; B41J 29/393
(52) U.S. Cl. ..... 347/15; 347/19
(58) Field of Search ..... 347/15, 43, 12, 347/19

(56) References Cited

U.S. PATENT DOCUMENTS 5,387,976 A * 2/1995 Lesniak ..... 347/19
5,856,833 A * 1/1999 Elgee et al. ..... 347/19
6,109,723 A * 8/2000 Castle et al. ..... 347/19

FOREIGN PATENT DOCUMENTS

| | | |
|---|---|---|
| JP | 4-173150 | 6/1992 |
| JP | 5-220978 | 8/1993 |
| JP | 9-11508 | 1/1997 |

* cited by examiner

*Primary Examiner*—Thinh Nguyen
(74) *Attorney, Agent, or Firm*—Dellett and Walters

(57) ABSTRACT

A sensor configuration and signal processing, which are not affected by a paper rise when a print pattern for auto head shading and density correction is read, are provided. A predetermined print pattern is printed with a plurality of heads, and the predetermined pattern that is printed is scanned with a sensor (110) to detect a density unevenness for the print pattern in each color on a nozzle basis. The sensor (110) comprises a light emitting element which emits a light including all light regions, R, G, and B, and a plurality of light receiving elements each of which receives R, G, and B lights, respectively. The plurality of light receiving elements are arranged in a main scanning direction. The print pattern printed by each head is read by the light receiving element for the complementary color light of the pattern and the light receiving element for a non-complementary color light of the pattern, and a change in density level in the nozzle column direction is detected based on the difference between the two outputs.

6 Claims, 18 Drawing Sheets

| ADDRESS | |
|---|---|
| 0 | 31 |
| 1 | 33 |
| 2 | 40 |
| . | . |
| . | . |
| . | . |
| . | . |
| 254 | 40 |
| 255 | 36 |

SIDE VIEW

FRONT VIEW

IMAGE FORMING DEVICE

TECHNICAL FIELD

The present invention relates to an image forming device that forms an image using an ink jet recording method.

BACKGROUND ART

Conventionally, this type of image forming device uses an ink jet recording method in which pulse signals are applied to a plurality of heaters, provided in an ink-filled nozzle, to heat them until ink boils to cause the bubble pressure to eject the ink. In an image forming device using this method, a plurality of such nozzles are arranged to constitute a head and a plurality of such heads (for example, each ejecting a color ink such as cyan, magenta, yellow, or black ink) are combined to form a full-color image.

In such an image forming device, the control circuit, which drives each head, is configured as shown in FIG. 18. This figure shows the configuration of only one head. In this figure, numerals 1801 and 1802 indicate shift registers, numerals 1803 and 1804 indicate latch circuits, numeral 1805 indicates a decoder circuit, numeral 1806 indicates an AND circuit, numeral 1807 indicate transistors, and numeral 1808 indicates heaters. Image data VDO1 and VDO2, sent from an external unit in the form of serial binary data in synchronization with a transfer clock CLK, are sequentially converted from serial to parallel by the shift registers 1801 and 1802. Eight units of image data VDO1 and VDO2 are transferred and then latched in the latches 1803 and 1804 by the LAT signal. A head, composed of a plurality of nozzles, is divided into n blocks (in this example, a 256-nozzle head is divided into 16 blocks). One enable signal, BE0–BE15, and a heater driving signal HE are given to a block to turn on the transistors of the nozzles with which image data is stored in the enable state. These signals heat the heaters of the nozzles to eject the ink. In the image forming device, the block enable signal BE is converted from 4-bit code data to 16-bit data by the decoder 1805. When the block enable signal BE, image data VDO1 and VDO2 each composed of eight units of data, and the heater driving pulse signal HE are all turned on, the ink is ejected.

One column of data is printed as shown in FIG. 19 by this control. Repeating this operation for the number of columns in the main scanning direction prints one band of data. The paper sheet is fed one band to print the second band of data. This operation is repeated a lot of times to form an entire image composed of a lot of bands.

To print data in precise positions even when the carriage speed changes, a linear scale 109 with slits each for one or several dots is usually provided in parallel with the carriage movement path as shown in FIG. 20. A sensor 2003, provided near a head 101, reads this scale and outputs a signal to synchronize ink ejection so that the ink is ejected in correct positions.

However, unevenness in the shape or in the direction of ejection apertures causes unevenness in horizontal and vertical ink ejection positions on paper. At the same time, the heater size and contaminants near the nozzles cause unevenness in amount of the ink ejected per nozzle. When an image is printed at the same density with a print head composed of those recording elements, the image is printed not evenly but there is an unevenness in density. For example, as shown in the example in FIG. 21, an attempt to record a pattern at the 50% of image density results in uneven density printing depending upon the positions of nozzles on the print head.

A technology, called head shading, is proposed as means for correcting this uneven density printing. This technology is such that a check is made for density unevenness in image data recorded by all recording elements of the recording head at the same density and, based on the density unevenness, the density of image data output from each nozzle is adjusted.

For example, in position A in the head width direction, shown in FIG. 21, where the density is higher than the intended density of image data, the density level of the image to be output with that nozzle is decreased in advance. Conversely, in position B in the figure where the actual recording density is lower than the density intended by the image signal, the density level of the image to be output with that nozzle is increased in advance. This adjustment significantly reduces an unevenness in recording density caused by the recording head.

There are two means for checking and correcting the recording density: auto head shading and manual head shading. In the auto head shading, a recorded image pattern is read by a scanner or some other unit provided in the recording unit for automatic detection and correction of density unevenness. In the manual head shading, a user visually checks a recorded image pattern to determine the density unevenness and correction values.

When the auto head shading is performed on the image forming device described above, either a scanner separate from the device or a sensor built in the device is used to read the print result of a predetermined pattern printed by the device to check for an uneven density. At this time, in the method in which a scanner is used, the paper sheet on which the predetermined pattern has been printed must be taken out of the output section of the device and then placed on the glass window of the scanner. The printed paper sheet placed on the glass window is pressed flat by the cover, and the printed pattern is read by a high-resolution CCD line sensor. However, this method requires user's intervention from the time the predetermined pattern is printed to the time the printed paper sheet is set on the glass window of the scanner, making the operation complex. To implement the device with a printer which has no scanner built in, there are a lot of problems: for example, the user must purchase a scanner separately and install a software product that reads image data from the scanner to analyze an unevenness density in the image data. Therefore, to implement the device with only a printer and to implement the auto head shading function, a sensor is preferably built in the printer to allow the sensor to read the printer pattern.

One of sensors that may be used in a printer is a CCD. However, a CCD has the problems given below.

- The CCD and the light-emitting halogen lamp are expensive.
- The CCD driving circuit and the output signal processing circuit are complex.
- The use of a halogen lamp requires additional heat-insulating parts.

The problems described above make the unit larger.

Therefore, the CCD, if used in the device only to implement the auto head shading function, involves a lot of problems such as a larger unit size, increased cost, complex design, and so on. To avoid these problems, a low-cost reflective-type sensor is usually provided near the carriage to detect a printed head shading pattern with that reflective-type sensor.

However, when a reflective-type sensor is used to detect a pattern on the printed surface, a piece of paper is raised on the platen if the paper is too tough. Conversely, if a piece of paper is too soft, the paper becomes non-flat because cockles are sometimes generated thereon after the pattern is printed. In this state, reading the pattern with the reflective-type sensor causes changes in read-out signal level from the reference level (GND) depending on places on the paper surface even if the density level is constant. Therefore, even if correction data for auto head shading is calculated using this output, it is difficult to check the density unevenness correctly. The present invention seeks to solve the problems associated with the prior art described above. It is an object of the present invention to provide an image forming device capable of detecting the pattern density level correctly even if a print paper is raised or cockles are generated thereon.

DISCLOSURE OF INVENTION

To achieve the above objects, an image forming device according to the present invention is an image forming device using an ink jet recording method, the device forming a color image using a plurality of heads each of which has a plurality of ink ejection nozzles thereon, the device comprising means for printing a print pattern at a predetermined density using the plurality of ink ejection nozzles, one head at a time, on a print paper; a reflective-type optical sensor which reads the print pattern in each color while scanning the print pattern in a nozzle column direction; and density calculating means for calculating a density of the print pattern in each color based on an output of a reflective-type optical sensor, wherein the reflective-type optical sensor comprises a light emitting element which emits a light including all lights in red/blue/green regions on an optical wavelength and a plurality of light receiving elements each of which detects a light in one of the red/blue/green regions on optical wavelength, and wherein, based on an output of the light receiving element for a complementary color light of each pattern color and an output of a light receiving element for a non-complementary color light of the pattern color, the destiny calculating means calculates a difference between the two outputs to detect a density level on a nozzle position basis for the print pattern printed by each head.

In this way, the difference between the two outputs is calculated to detect the density level based on the output of the light receiving element for the complementary color light of each pattern color and the output of a light receiving element for a non-complementary color light of the pattern color. By doing so, even if a paper rise or a cockle is caused when the print pattern is printed on a print paper, their effects on the output of the light receiving elements are canceled. Therefore, this method enables the pattern density level to be calculated correctly.

For example, the print pattern is a band pattern recorded by all ink ejection nozzles of each head and having a width corresponding at least to a head width, the plurality of light receiving elements are arranged in a main scanning direction, the reflective-type optical sensor has a rectangular light transmission slit with longer sides aligned in the main scanning direction so that an image of the print pattern in a predetermined position is formed on receiving surfaces of the plurality of light receiving elements, and the reflective-type optical sensor scans relatively in a sub-scanning direction with respect to the pattern.

The density calculating means preferably calculates the density level on a nozzle basis for each head. Using the result, the print density of each head may be adjusted on a nozzle basis according to the density level calculated on a nozzle position basis for each head.

BEST MODE FOR CARRYING OUT THE INVENTION

An embodiment of the present invention will be described below in detail by referring to the attached drawings.

Figure 1:
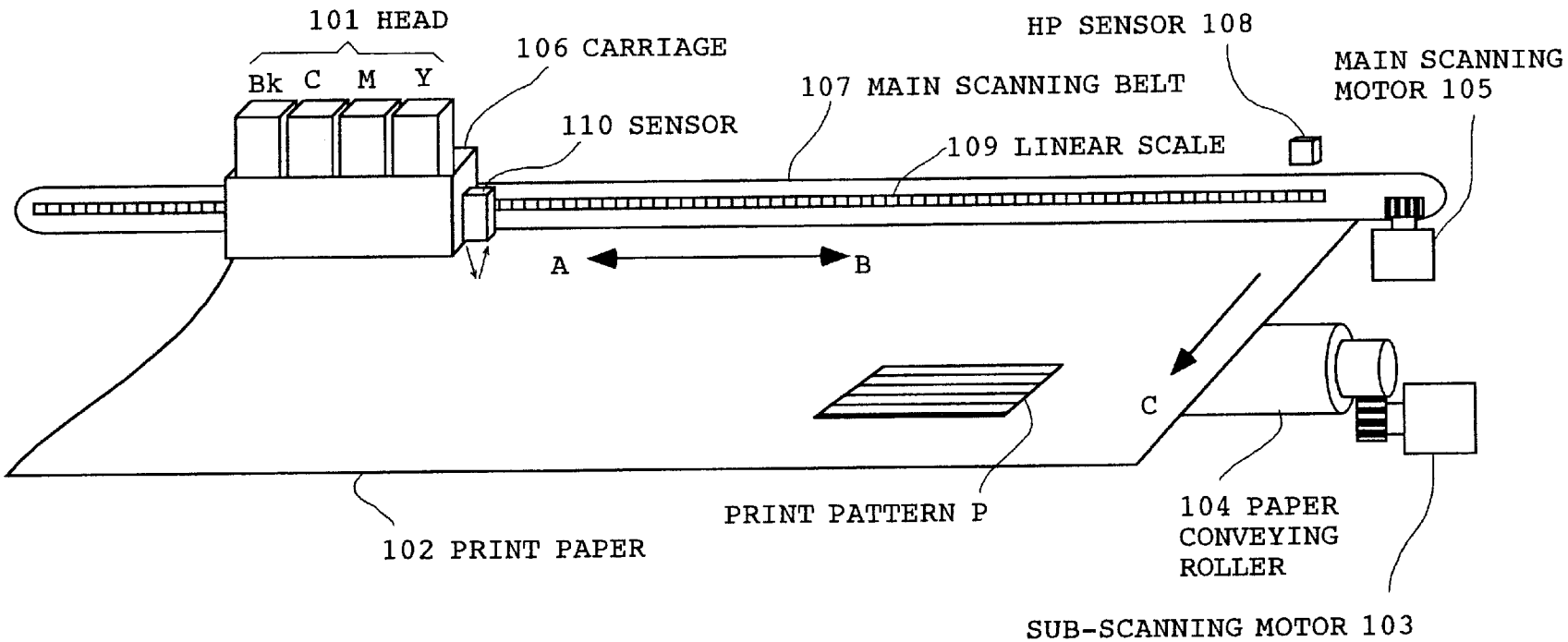
FIG. 1 is a diagram showing the body of an image forming device in an embodiment of the present invention.

FIG. 1 is a diagram showing the overview of an ink jet recording device in the form of a serial printer according to the present invention. Recording heads 101Bk, 101Y, 101M, and 101C are mounted on a carriage 106. Black, yellow, magenta, and cyan ink are supplied from ink tanks, not shown in the figure, to the recording heads via ink tubes. The ink supplied to the recording heads 101Bk, 101Y, 101M, and 101C is driven by recording head drivers corresponding to the recording signal in response to recording information from a main controller not shown in the figure. Ink droplets are ejected from each of the recording heads 101 for recording on a print paper 102.

A paper conveying motor 103 (sub-scanning motor), which is a driver intermittently feeding the print paper 102, drives a paper conveying roller 104. A main scanning motor 105 is a driver which moves the carriage 106, on which the head 101 is mounted, in the direction indicated by arrow A or B via a main scanning belt 107. When the print paper sheet 102 supplied by the paper-supply mechanism, not shown in the figure, and conveyed by the paper conveying roller 104 reaches a print position, the paper conveying motor 103 is turned off to stop the supply of the print paper sheet 102. Before an image is recorded onto the print paper sheet 102, the carriage 106 moves to the position of a home position (HP) sensor 108. Then, the carriage moves in the direction of arrow A for forward scanning. hen the carriage reaches a predetermined position, black, yellow, magenta, and cyan ink are started to be ejected from the recording heads, 101Bk–101C, to record an image. After a predetermined width (band) of image recording is finished, the carriage 106 stops and returns in the direction of arrow B for backward scanning until the carriage 106 reaches the position of the home position sensor 108. During the backward scanning, the paper conveying motor 103 moves the print paper sheet 102 in the direction of arrow C for the width recorded by the recording heads 101Bk–101C. Repeating this head scan operation and the paper feed operation records an entire image.

As described above, the linear scale 109 has high resolution slits. A transparent-type optical sensor (not shown in the figure) provided near the carriage 106 reads these slits to give two phase signals which are 90 degrees out of phase. Based on these signals, the carriage 106 position is controlled and the ink ejection from the print head 101 is synchronized.

In this embodiment, the print head with the resolution of 600 dots/inch and the linear scale with the resolution of 600 dots/inch are used to record an image at 600 dots/inch.

In this embodiment, not only the sensor for linear scale 109 but also a reflective-type optical sensor 110 is provided near the carriage 106. This reflective-type optical sensor is provided to perform the auto head shading. In order to correct a density unevenness caused by a manufacturing non-uniformity in shape and in angle of the ejection apertures of the head 101 installed on the carriage 106, the sensor reads a predetermined image pattern (print pattern) recorded by the print heads 101 to automatically check and correct an unevenness of the density in the device. This density unevenness detection operation, the most obvious advantage of the present invention, will be described below.

Figure 2:
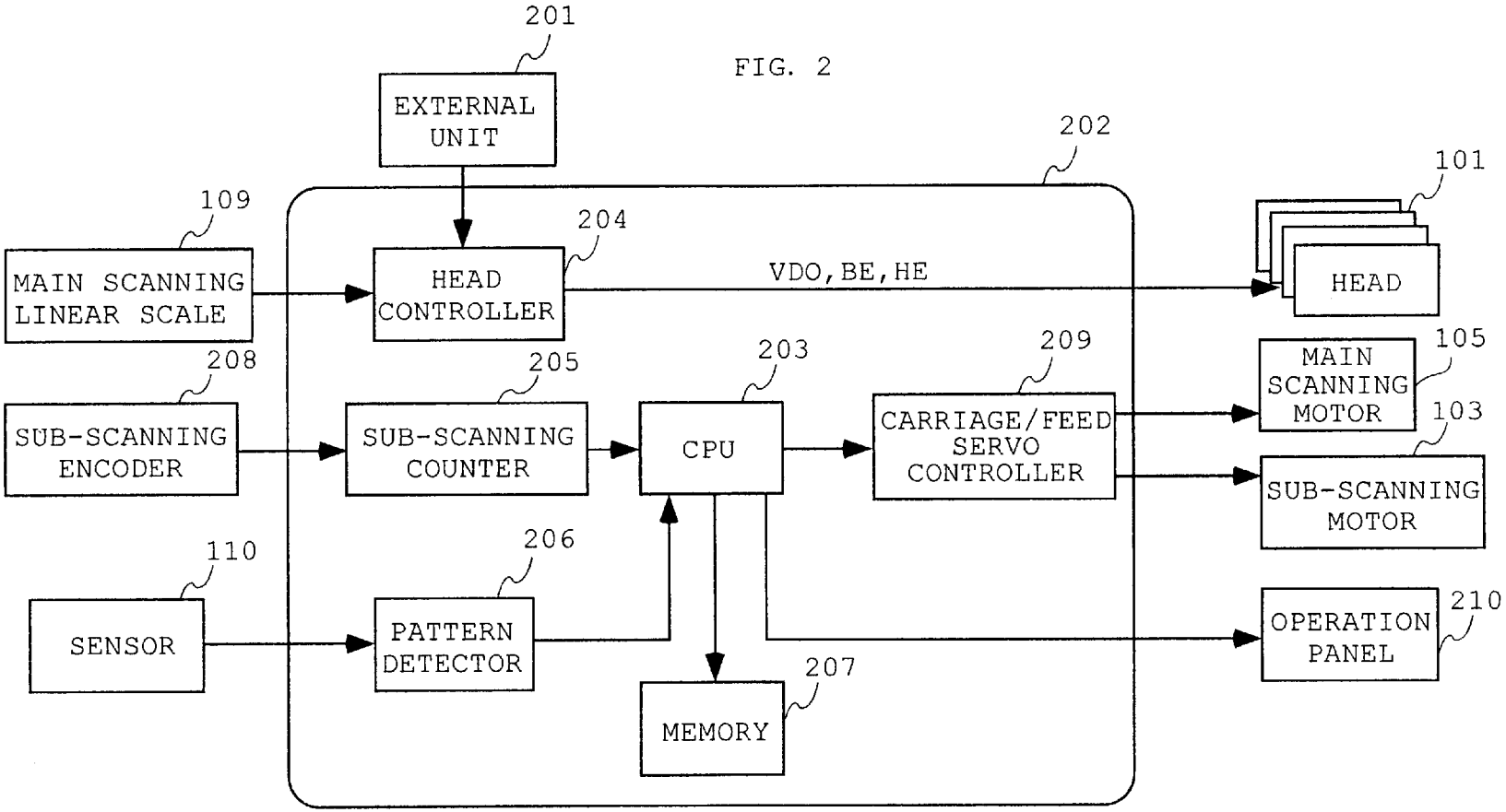
FIG. 2 is a diagram showing the control block of the embodiment shown in FIG. 1.

FIG. 2 is a block diagram showing the configuration of an image forming device according to an embodiment of the present invention. The image forming device shown in the figure comprises an external unit 201, a print controller 202, and the heads 101. Connected to the print controller 202 are the main scanning linear scale 109, sub-scanning encoder 208, main scanning motor 105, sub-scanning motor 103, sensor 110, and operation panel 210. The external unit 201, which is a host unit supplying image data to be recorded and various commands to the image forming device, is a unit such as a computer or an image reader. Based on image data VDI sent from the external unit 201, the print controller 202 controls the formation of an image recorded on a recording paper with the heads 101. The print controller 202 comprises a CPU 203, a head controller 204, a sub-scanning counter 205, a pattern detector 206, a memory 207, and a carriage/feed servo controller 209. Among these components, the CPU 203 acts as an interface with the external unit 201 from which image data VDI is sent and, at the same time, controls the entire operation of the print controller 202 including memories and I/O units. Upon receiving image data VDI from the external unit 201, the head controller 204 temporarily stores several bands of image data VDI in the image memory in response to an instruction from the CPU 203. Image processing is performed on the stored image data VDI. The processed result is output as image data VDO in synchronization with the scanning of the head 101.

In this embodiment, the main scanning linear scale 109 and the sub-scanning encoder 208 are provided as shown in the figure. The main scanning linear scale 109 outputs two phase signals when the main scanning motor 105 drives the carriage 106, and the sub-scanning encoder 208 outputs two phase signals when the sub-scanning motor 103 feeds the paper. These phase signals are represented respectively by absolute positions according to the amount of movement. The output of the main scanning linear scale 109 is used also as the synchronization signals for controlling output data such as image data VDO.

The head controller 204 also generates signals necessary for ejecting ink, such as the block enable signal BE for enabling each block of the head, heater drive pulse signal HE, and so on. The image data VDO, block enable signal BE, heater drive signal HE, and so on output from the head controller 204 are sent to the head 101. In the control circuit of the head 101, the heaters of only the nozzles for which the image data VDO and enable signals (BE, HE) are enabled are turned on. This causes ink to be ejected onto the recording paper to form one column of image. Performing this control while scanning the head 101 in the main scanning direction forms one band of image.

In response to the output from the main scanning linear scale 109 and the sub-scanning encoder 208, the carriage/feed servo controller 209 feedback-controls the drive speed, start, stop, and position based on the movement amount of the main scanning motor 105 and the sub-scanning motor 103.

The operation panel 210 is used by the user to issue instructions for operating the image forming device, such as instructions indicating the print mode, demonstration print, print head recovery operation, and so on. An operation instruction to be performed when a density unevenness is detected is also issued from the operation panel 210.

Figure 3:
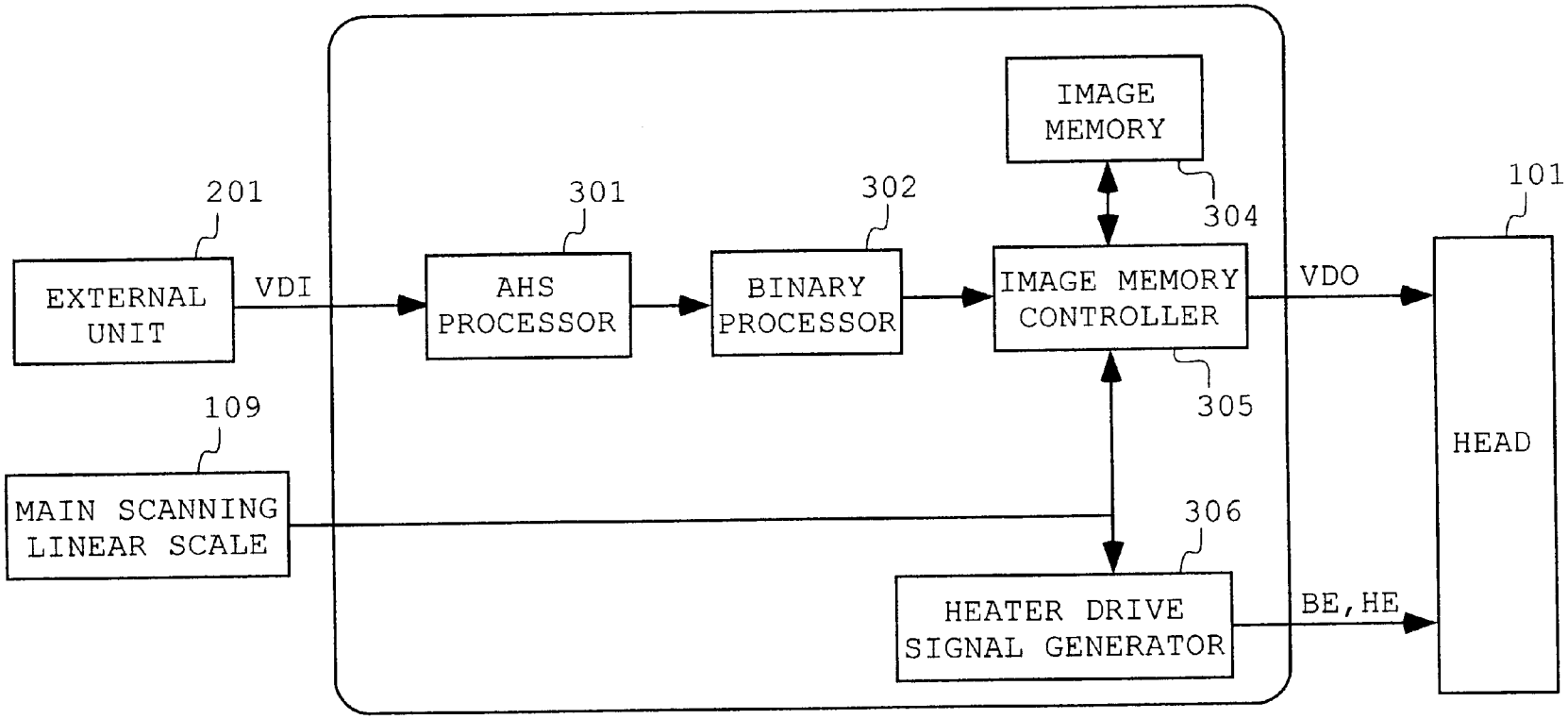
FIG. 3 is a diagram showing the block of the head controller in the embodiment shown in FIG. 1.

Next, the internal configuration of the head controller 204, which generates signals necessary for driving the head 101, and the brief description of its operation will be given with reference to FIG. 3. The head controller 204 mainly includes an AHS (Auto-Head Shading) processor 301, a binary processor 302, an image memory 304, an image memory controller 305, and a heater drive signal generator 306. The AHS processor 301 uses correction data, obtained through the auto head shading detection, to perform density conversion via a memory table for multi-value image data VDI (in this embodiment, image data of 256 gradations is input via an 8-bit bus for each pixel) sent from the external unit 201.

The binary processor 302 converts multi-value data, which was density-converted by the AHS processor 301, to binary data indicating whether or not the data is to be printed. During this processing, the dither method, error diffusion method, and so on are used to convert data to binary. Image data converted to binary by the binary processor 302 is stored temporarily into the image memory 304 by the image memory controller 305. As described above, the image memory controller 305 performs two types of memory control: one is to temporarily store several bands of image data VDI, which was sent from the external unit 201, into the image memory 304, and the other is to output the stored image data to the head 101 as the image data VDO in accordance with the scanning of the head 101. When the image data VDI is input to the image memory 304, the signal indicating an address in the image memory 304 is generated in synchronization with the timing in which the data is sent from the external unit 201 to allow the image data VDI to be stored sequentially. When data is output from the image memory 304 in accordance with the scanning of the head 101, the memory address signal is generated in synchronization with the output of the main scanning linear scale 109 to allow the image data VDO to be output from the image memory 304.

In addition, the heater drive signal generator 306 generates the signal (block enable signal BE0-3) selecting a block of the head to be driven and the heater drive pulse signal HE in synchronization with the output from the main scanning linear scale 109. As described above, ink is ejected from only the nozzles on the head 101 for which the block enable signal BE0-3, heater drive signal HE, and image data VDO are all enabled.

Figure 4:
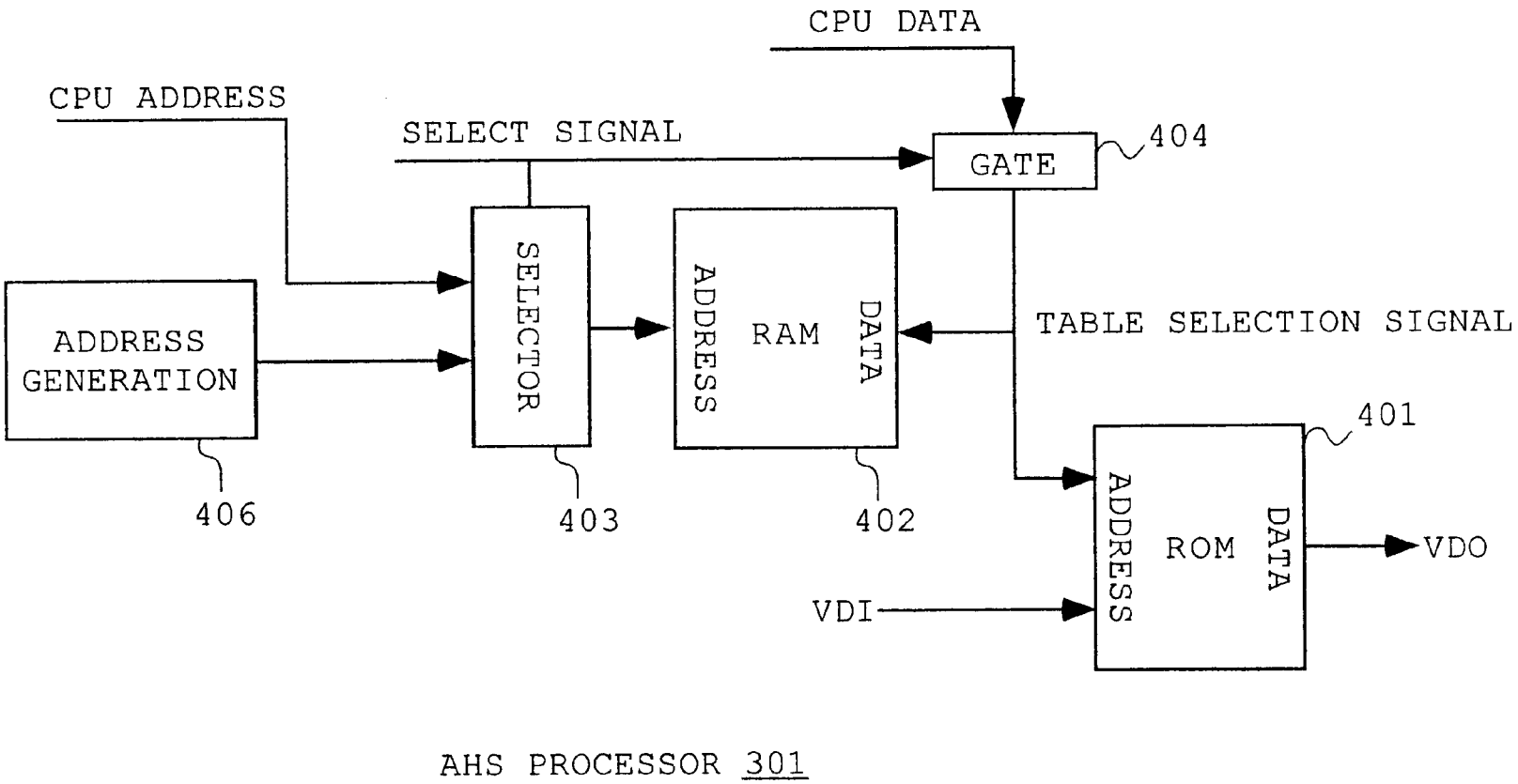
FIG. 4 is a diagram showing the block of an AHS (Auto Head Shading) processor in the embodiment shown in FIG. 1.

FIG. 4 is a block diagram showing in detail the configuration of the AHS processor 301. In FIG. 4, numeral 401 indicates a table ROM. Entered image data signal VDI is converted according to the contents of the table ROM 401. The image signal from the external unit 201 is entered into the low-order address of the table ROM 401 and, via the lookup table in the table ROM 401, the corresponding value is output. The table ROM 401 has a plurality of tables each containing such a data group. One of the tables is selected according to the table selection signal connected to the high-order address of the table ROM 401. In this embodiment, the density level of the image signal ranges from 0 to 255, and the number of tables contained in the table ROM 401 is 64. Therefore, the low-order 8 bits of the table ROM 401 contains the image signal, while the high-order 6 bits contains the table selection signal.

Figures 5, 6:
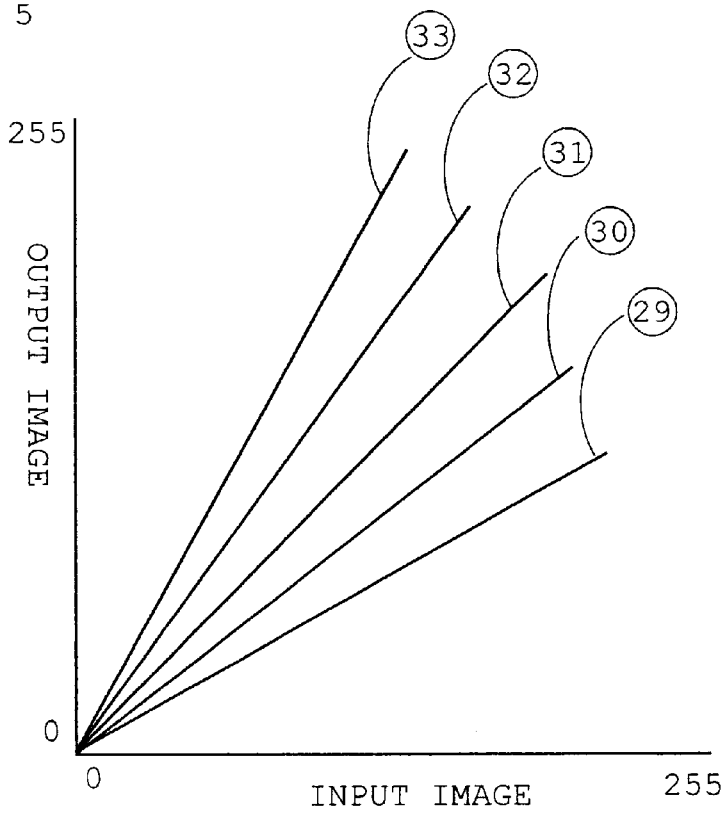
FIG. 5 is a diagram showing the data configuration in a table ROM in the AHS processor in the embodiment shown in FIG. 1.
FIG. 6 is a diagram showing the data configuration in a RAM which generates table selection signals in the AHS processor in the embodiment shown in FIG. 1.

FIG. 5 is a diagram showing the configuration of table data stored in each table in the table ROM 401. As described above, the table ROM 401 has a total of 64 tables each assigned with a number ranging from 0 to 63. For example, the number 31 corresponds to a data-through table; when this table is selected, the ratio of the magnitude of input data to that of output data is 1 to 1. When a table with a number smaller than 31, such as table 30, 29, . . . is selected, the level of the image signal output from the table ROM 401 is lower than the input image signal level. Conversely, when a table with a number larger than 31, such as table 32, 33, . . . is selected, the level of the image signal output from the table ROM 401 is higher than the input image signal level. Although omitted in the figure, the table with the lowest image signal level is table 0 and the table with the highest image signal level is able 63.

Returning to FIG. 4, numeral 402 is a RAM from which the table selection signal is generated. The RAM 402 contains a selection signal corresponding to each nozzle. This will be described with reference to FIG. 6. The RAM 402 contains data in addresses 0–255 each of which corresponds to the number of a nozzle on the head 101 shown in FIG. 1. For example, in the example shown in FIG. 6, data selecting table 31 is stored in address 0, and data selecting table 33 is stored in address 1. To write data into the RAM 402, data is input from the CPU 203 in FIG. 2 via a gate 404 shown in FIG. 4. When writing data into the RAM 402 in response to the select signal from the CPU 203, the selector 403 is switched to the CPU address bus. When printing data, the selector 403 selects address data from an address generator 405 to allow an address in the RAM 402 to be selected for image data corresponding to each nozzle.

In the above description, although only one color of the heads 101 was described, the device has four recording heads, each for C, M, Y, and K. So, the AHS processor 301 has four systems, one for each color. However, because the same processing is performed for all colors, the following describes the recording of data in one color for convenience of description.

Figure 9:
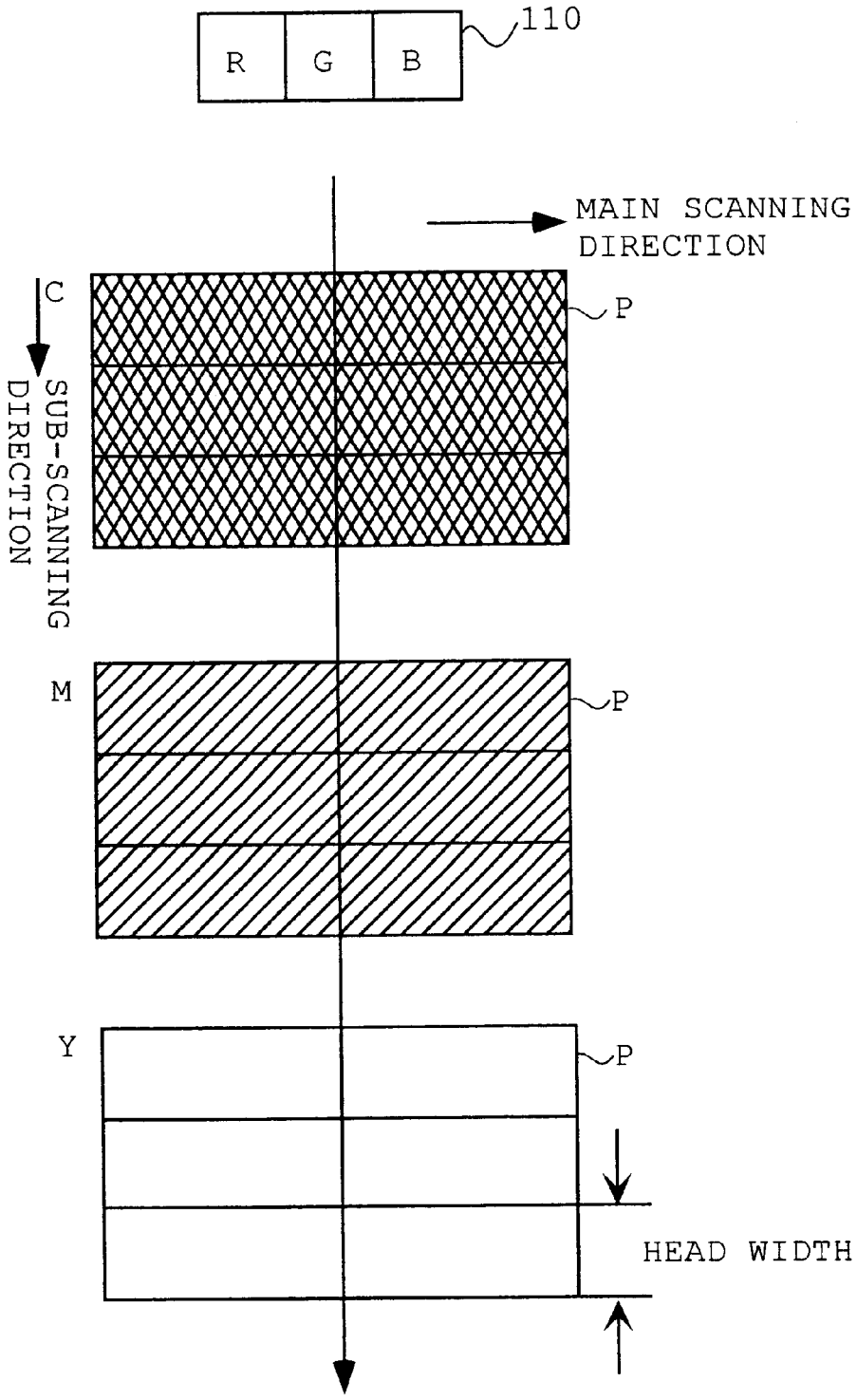
FIG. 9 is a diagram showing the AHS pattern configuration in the embodiment shown in FIG. 1.

Next, head shading processing will be described by referring to the flow chart shown in FIG. 7. Pressing a head shading operation key (not shown) on the operation panel 210, in step S1, disables the head shading. More specifically, "31" is written in all addresses in the RAM 402 shown in FIG. 4 to make all nozzles select the through table "31" in the table ROM 401. Next, control is passed to step S2. As shown in FIG. 9, three bands of image patterns, each of which has a density of 50% and is even in density, are recorded. The band at the center of each three bands is read for density correction. One extra band is printed before and after the band that is used for correction to correct a density unevenness considering the effect of a connection part between the bands.

More specifically, the head shading patterns shown in FIG. 9 are printed for four colors, C, M, Y, and K, each at 50% in density. These patterns are printed three bands in parallel using the 256 nozzles of a head for each scanning. In the figure, the print result of only three colors, C, M and Y, is shown.

Figure 7:
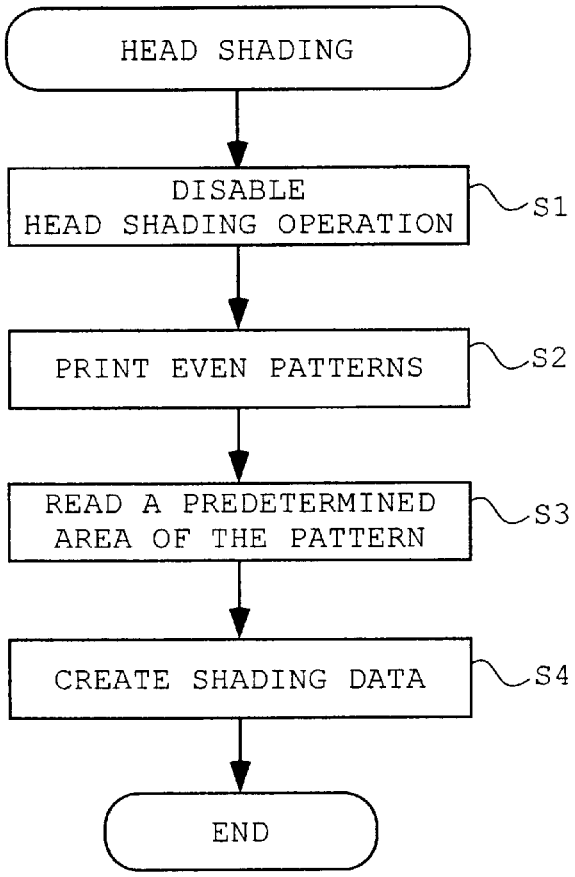
FIG. 7 is a diagram showing an operation flow in which AHS pattern read operation is executed in the embodiment shown in FIG. 1.

Next, control is passed to step S3 in FIG. 7. The carriage 106 is moved to position the sensor 110 above the image printed in step S2, the print paper is conveyed in the sub-scanning direction, so that the image pattern is read from the predetermined area for the pattern of each color. The data that is read is stored in the memory 207. After reading the image in step S3 in this way, control is passed to step S4 to create shading data. First, head shading data for the pattern of the C color is created and then head shading data for the patterns of other colors is created sequentially. The created data is stored in a predetermined area in the memory 207.

Figure 8:
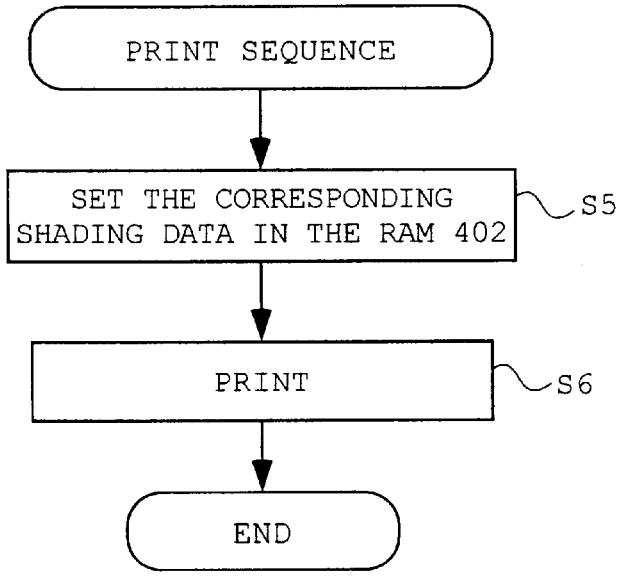
FIG. 8 is a diagram showing an operation flow when the print operation is executed in the embodiment shown in FIG. 1.

FIG. 8 is a flow chart showing the operation in the actual print sequence. First, in step S5, corresponding data is read from the memory 207 and is set in the RAM 402. The print operation starts in step S6.

Figure 10A:
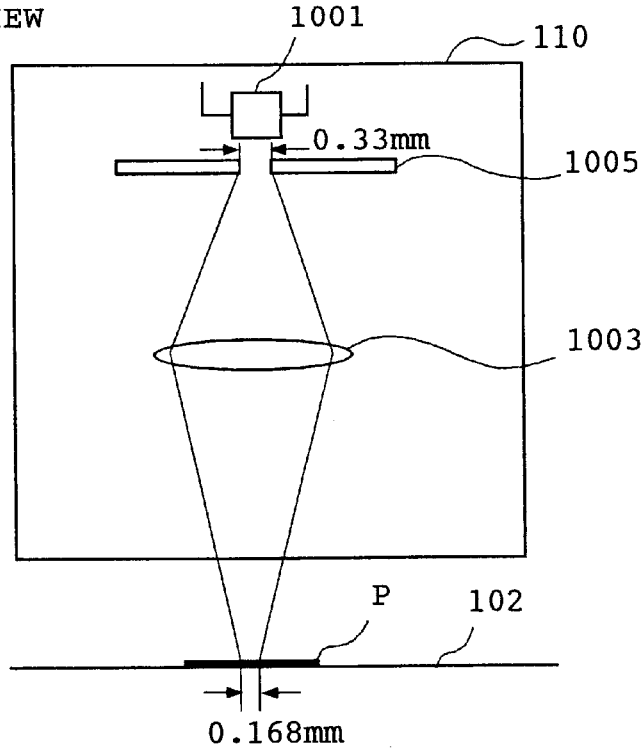
FIGS. 10(*a*) and (*b*) are diagrams showing the internal configuration of a sensor in the embodiment shown in FIG. 1.
Figure 10B:
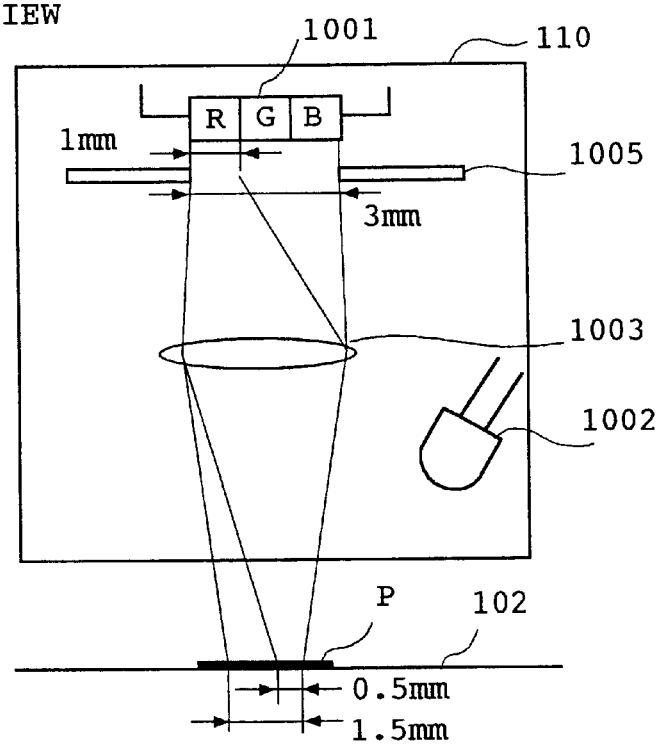

FIGS. 10(*a*) and 10(*b*) show the internal configuration of the sensor 110 used in the image forming device. (a) is a side view, and (b) is a front view. In FIGS. 10(*a*) and 10(*b*), numeral 1001 is a light receiving element, composed of a photo-transistor or a photo diode, for detecting the light band of the frequency (or wavelength) of R, G, and B, respectively, with the use of a filter or the like. Numeral 1002 indicates a light emitting element, such as a tungsten lamp, capable of emitting light including all optical regions, that is, R, G, and B. Numeral 1003 indicates an optical lens.

Light emitted from the light emitting element 1002 falls on a density-unevenness detection pattern P. The reflected light is focused by the optical lens 1003 onto the light receiving element 1001 to detect the density level of the pattern on a nozzle position basis. The light receiving element 1001 is arranged in order of R, G, and B in the main scanning direction with the light receiving surface size of each color being 1 mm×1 mm. With a two-fold magnifying lens as the optical lens, the average density of a 0.5 mm area in the main scanning direction may be detected. In the sub-scanning direction, a light transmission slit 1005 with a 0.33 mm aperture is arranged above the light receiving surface of the light receiving element 1001 to detect the average density of 0.168 mm area. Because the nozzle resolution of the print head 101 is 600 DPI, the average density of about 4 dots is detected in this configuration. It should be noted that the detection area size is not limited to this size. However, the size is determined considering the fact that a size smaller than the above-described size makes the sensor output too small and that a size larger than the above-described size makes it difficult to correctly detect a change in the nozzle-basis density. Even when the average density of a plurality of nozzles must be detected, pattern sampling of one-nozzle-position unit or a smaller unit allows the density level to be detected on one-nozzle-position unit basis. In addition, even when pattern sampling must be done for a plurality of nozzles, the density level of a one-nozzle position may be detected by interpolating the output.

Figure 11:
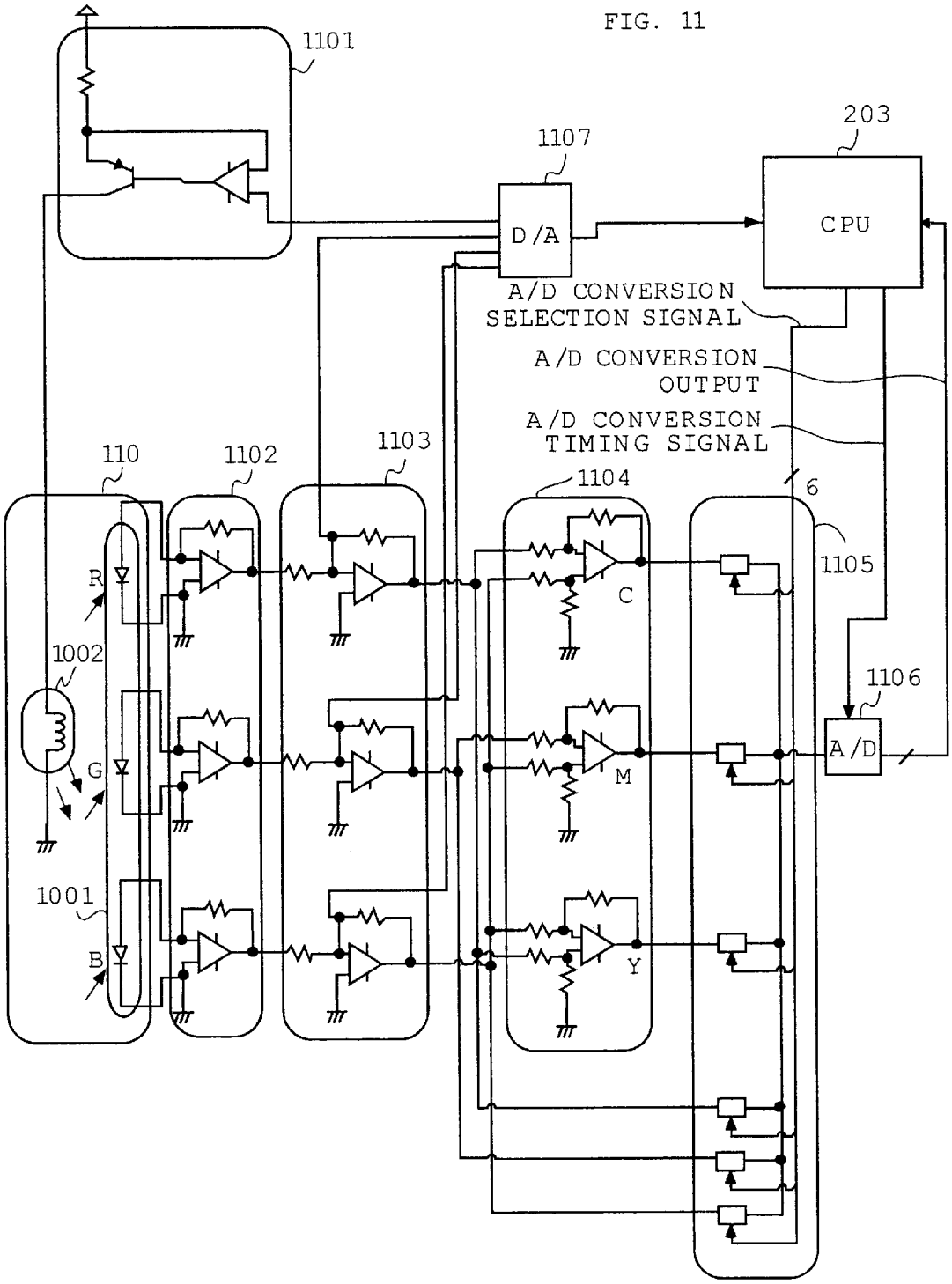
FIG. 11 is a diagram showing in detail a pattern detection circuit in the embodiment shown in FIG. 1.

Based on the output of the sensor 110, the pattern detector 206 in the print controller 202 detects the density level of the pattern on a nozzle position basis. FIG. 11 shows the details of the pattern detector 206. In the figure, numeral 1101 indicates a constant-current circuit for driving the light-emitting element, numeral 1102 indicates an I-E amplifier which converts an electric current to an electric voltage while amplifying the current generated by the light receiving element, and numeral 1103 indicates a summing amplifier which further amplifies the output of the I-E amplifier 1102 and at the same time adjusts the offset voltage of the light receiving element output with the use of the CPU 203. Numeral 1104 indicates a subtraction circuit which calculates the difference between two outputs out of three outputs from the summing amplifier 1103, numeral 1105 indicates an analog switch which selects a signal that is input from the output of the subtraction circuit 1104 to an A/D converter 1106 (analog to digital converter), and numeral 1107 indicates a D/A converter which sets in the CPU 203 an adjustment value used to adjust the light emission amount of the light emitting device in the sensor 110 and the offset amount of the sensor 110. The analog switch 1105 selects not only the output of the subtraction circuit 1104 but also output of the summing amplifier 1103. The switch causes the CPU 203 to generate the A/D conversion selection signal to select which of these two outputs to A/D convert. This allows the CPU 203 to adjust the light-emission amount of the light emitting element of the sensor 110 and the output offset of the light receiving element of the sensor 110 so that the sensor output becomes constant before the density unevenness detection pattern is detected.

Figure 12:
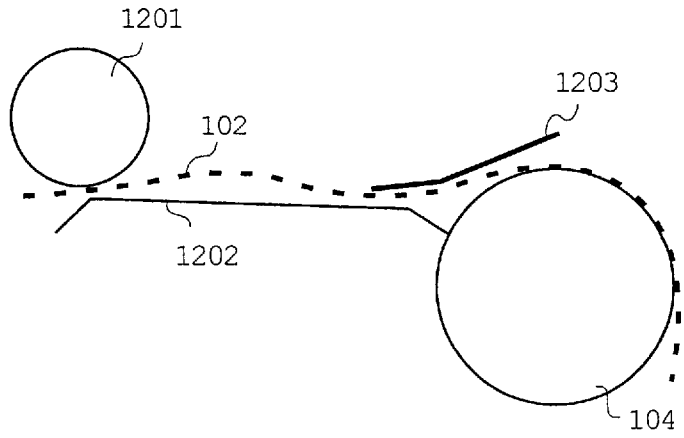
FIGS. 12(*a*) and (*b*) are diagrams showing behaviors of a print paper sheet on which a problem such as a paper rise occurs in the embodiment shown in FIG. 1.
Figure 12:
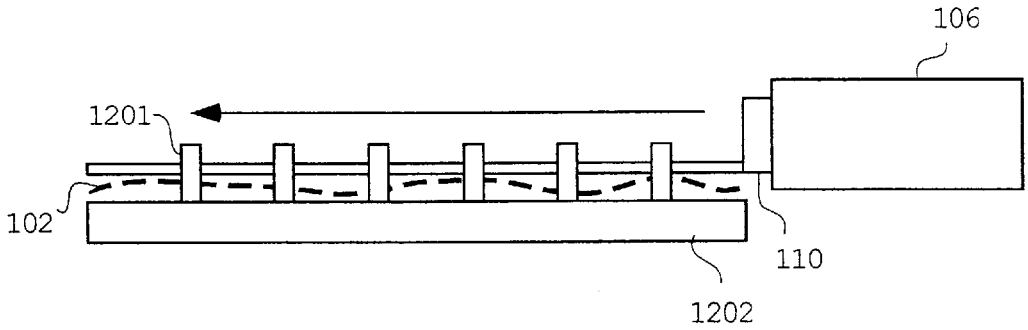
Figure 13:
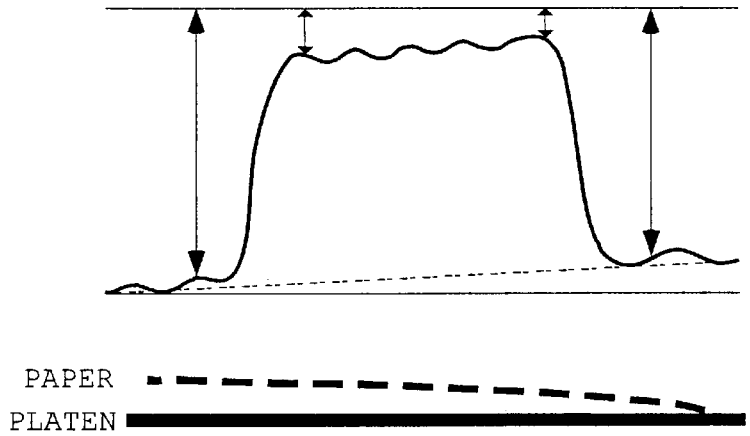
FIG. 13 is a diagram showing the sensor output condition when a problem such as a paper rise occurs in the embodiment shown in FIG. 1.

After adjustment is finished, a density unevenness detection pattern is read for pattern detection. To read the pattern, the carriage 106 moves in the main scanning direction to position the sensor 110 above the pattern as described above. The A/D conversion timing signal is generated by the CPU 203 in synchronization with the output of the sub-scanning counter 205 while conveying the print paper in the main scanning direction, and the output of the A/D converter 1106 is stored sequentially into the memory 207. When reading a pattern printed with the cyan head, the analog switch 1105 is turned on so that the difference between the output of the light receiving element for detecting the R light and the output of the light receiving element for detecting the B light is input to the A/D converter 1106. Also, when reading a pattern printed with the magenta head, the analog switch 1105 is turned on so that the difference between the output of the light receiving element for detecting the G light and the output of the light receiving element for detecting the B light is input to the A/D converter 1106. In addition, when reading a pattern printed with the yellow head, the analog switch 1105 is turned on so that the difference between the output of the light receiving element for detecting the B light and the output of the light receiving element for detecting the R light is input to the A/D converter 1106. As shown in FIG. 12(*a*), the print paper sheet 102 supplied by the paper conveying roller 104 is held with a paper ejection roller 1201 and a paper holding plate 1203 on the print paper over which the head 101 moves forward and backward in the main scanning direction. In this case, if the print paper sheet 102 is too tough against a platen 1202, the paper tends to rise. Conversely, if the paper is too soft, cockles are generated in the main scanning direction as a result of printing as shown in FIG. 12(*b*). In such a case, as shown in FIG. 13, the distance between the light receiving element of the sensor 110 and the print paper varies from position to position. At the same time, the intensity at which the light from the light emitting element strikes against the print paper varies from position to position. Therefore, even if the pattern density is even, the level at which the light receiving element of the sensor 110 produces its output varies, thus preventing the density of the output of the light receiving element of the sensor 110 from being measured correctly.

Figure 14:
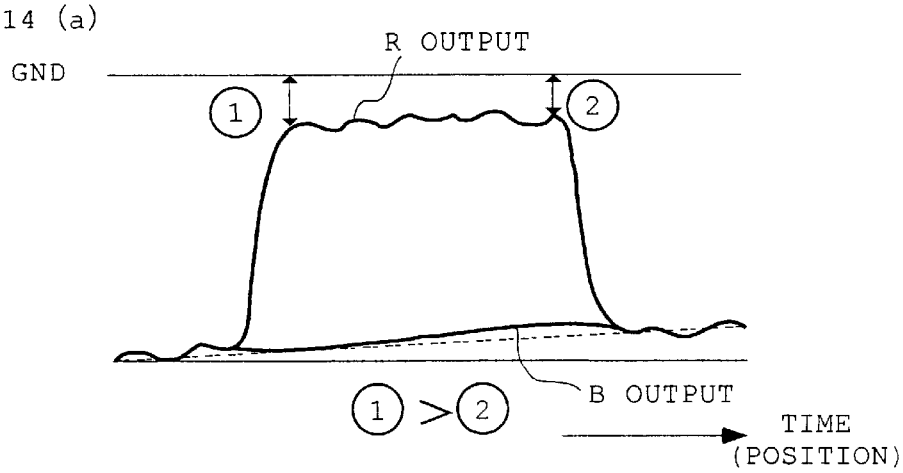
FIGS. 14(*a*) and (*b*) are diagrams showing the signal processing of the pattern detector in the embodiment shown in FIG. 1.
Figure 14:
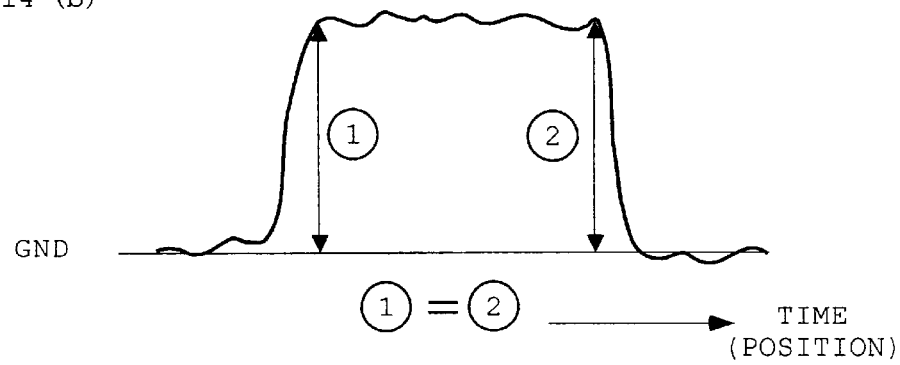

Therefore, when reading a pattern printed with the cyan head in the device according to the present invention, the difference between the output of the light receiving element for detecting the R light and the output of the light receiving element for detecting the B light is input to the A/D converter 1106 as described above. To do so, the light from the light emitting element including all regions, R, G, and B, such as a light from a tungsten lamp, is stricken on the pattern color to be measured, and the subtraction result is read with the use of the light receiving element (such as the one for R light) absorbing the pattern color light and the light receiving element (such as the one for B light) reflecting the pattern color light. Thus, even if the state of the print paper is unstable as shown in FIG. 14(*a*), this method enables a stable result, such as the subtraction result shown in FIG. 14(*b*), to be obtained. This is because the output of each light receiving element changes according to the reference level.

Figure 15:
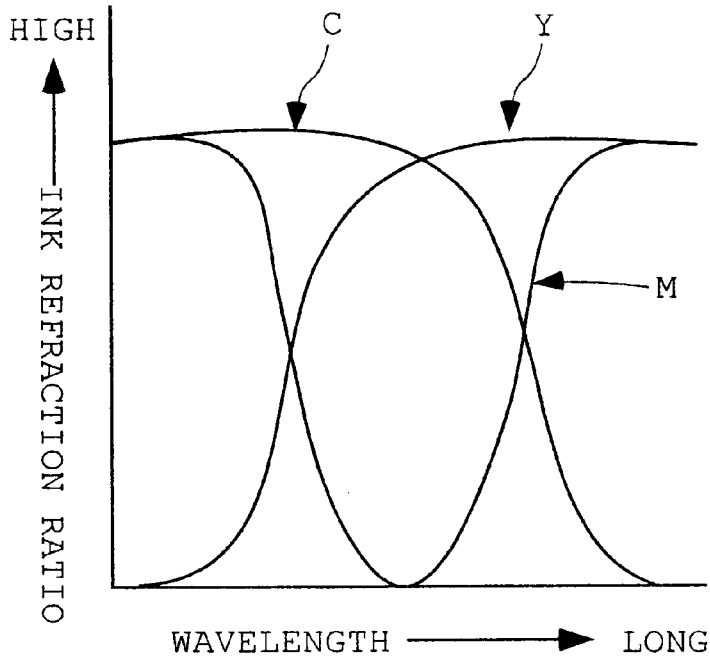
FIGS. 15(*a*) and (*b*) are diagrams showing how light reflects on a pattern color.
Figure 15:
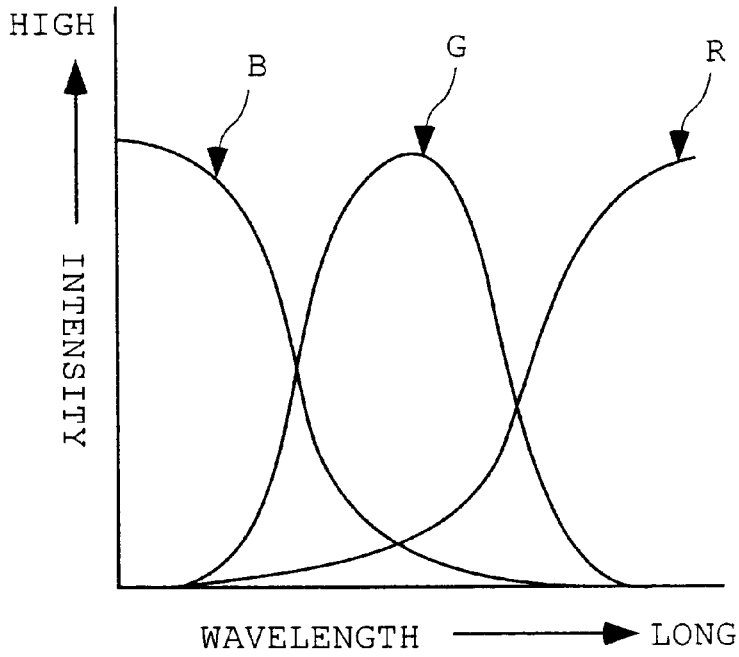

The supplementary description of this reason will be given with reference to FIGS. 15(*a*) and 15(*b*). The graph in FIG. 15(*a*) shows the refraction factor of the ink of each color (Y, M, C) with respect to the change of light wavelength, while FIG. 15(*b*) shows the intensity of each optical component (R, G, B) with respect to the change of wavelength. When a light is stricken onto a pattern from a light emitting element emitting a light including all regions, R, G, and B, FIGS. 15(*a*) and 15(*b*) indicate that yellow ink absorbs light in the blue region with a short wavelength, that magenta ink absorbs light in the green region with a medium wavelength, and that cyan ink absorbs light in the red region with a long wavelength. As a result, when a light is stricken onto a cyan pattern, the light in the red region is absorbed and therefore no output is generated from the red light receiving element in that pattern area (OFF state). Because the light is reflected outside the pattern area, an output is generated from the red light receiving element (ON state). This means that whether or not a cyan pattern is present in the background paper may be determined by using a red light receiving element.

On the other hand, when a light is stricken onto a cyan pattern, the light in the blue and green regions is reflected. Therefore, regardless of whether the light falls in or outside the cyan pattern, the blue and green light receiving elements generate an output (ON state). That is, it may be said that an output in the area of a light receiving element pattern for detecting a non-complementary color of the pattern is largely subject to the rise or cockles of the paper. For example, when detecting a cyan pattern, calculating the difference between the light (red) in the complementary color region and a light (blue or green) in the non-complementary region color by taking advantage of the characteristics of the light receiving elements described above cancels the output level change from the reference level in the subtraction result even if the level change is generated by a paper rise or a cockle. This is because the output level change of the two light receiving elements, caused by a paper rise and so on, is the same. For this reason, the pattern density may be measured correctly.

In the same way, the magenta pattern density may be measured correctly by calculating the difference between the green light (complementary region light) and the red or blue light (non-complementary region light), and the yellow pattern density may be measured correctly by calculating the difference between the blue light (complementary region light) and the red or green light (non-complementary region light).

Figure 22:
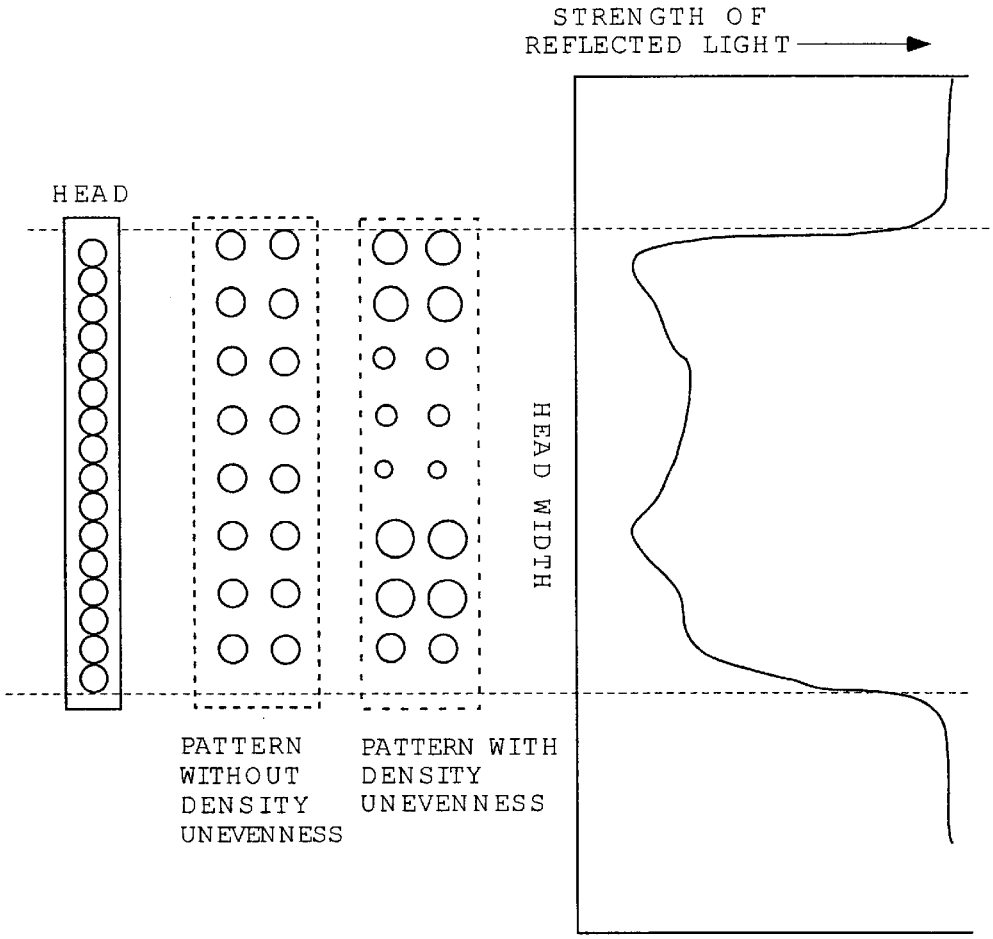
FIG. 22 is a diagram for explaining a pattern where the density is uneven.

It was described above that, when a color pattern is read using a light in the complementary color region, no output is generated from the light receiving element (OFF state). Actually, however, because a pattern is printed not at 100% but at about 50%, the ink is ejected in some parts within the pattern area and the background paper is exposed in the other parts within the pattern as shown in FIG. 22. (The print pattern in FIG. 22, illustrated schematically, does not always match the actual print pattern. It should be noted that, at 50% of density, ink is not ejected from all nozzles on one head at the same time but that all nozzles of the head are used dispersedly). The mixture, within a pattern area, of ink ejected parts and non-ejected background parts causes the following effect. In a part where the printed dot is large (the ink ejection amount is large), a large amount of complementary region light is absorbed, a small amount of light is reflected from the background paper, and therefore the sensor output is small. Conversely, in a part where the printed dot is small (the ink ejection amount is small), a small amount of complementary region light is absorbed, a large amount of light is reflected from the background paper, and therefore the sensor output becomes large. Based on the change in the sensor output level like this, it is possible to detect a density change (density unevenness) in the nozzle column direction of the print pattern as described above.

Figure 16:
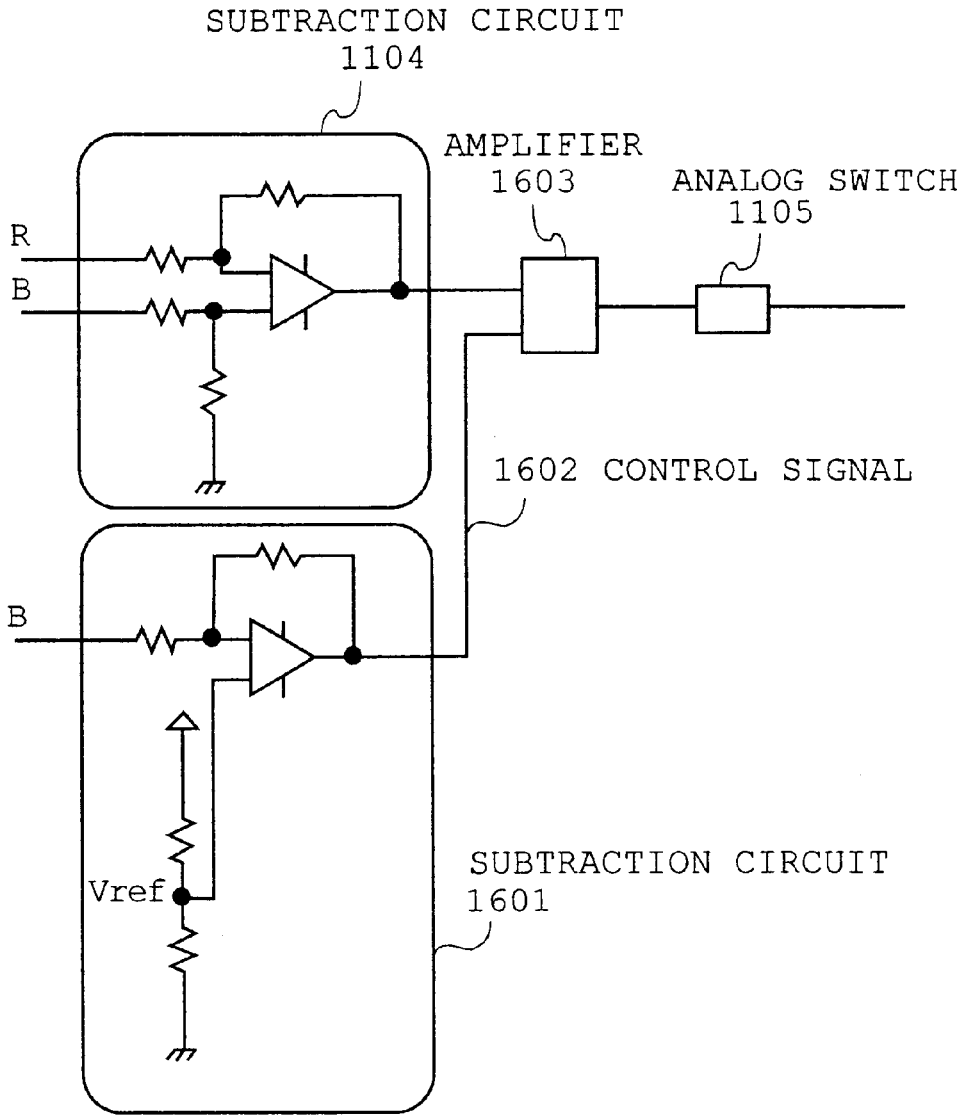
FIG. 16 is a diagram showing in detail the pattern detector in the embodiment shown in FIG. 1.

Subtracting the output of one light receiving element from the output of the other light receiving element as described above allows the pattern density to be measured with the minimum dependency on the print paper status. However, strictly speaking, there is a possibility that the intensity of reflected light varies according to the paper status and, therefore, the level change in the sensor output cannot be fully canceled. The measures described below may be taken for this problem. An example of detecting a cyan pattern will be described. As shown in FIG. 16, a circuit 1601 for subtracting the output of the light receiving element for the B light, which is not the complementary color, from a reference level Vref is provided in addition to the subtraction circuit 1104 for calculating the difference between the output of the light receiving element for the R light, which is the complementary color, and the output of the light receiving element for the B light which is not the complementary light. The output of the subtraction circuit 1104 is amplified with an output 1602 of the added circuit as the control signal (amplification factor) of a gain control amplifier 1603. The amplified result is A/D converted via the analog switch 1105 to correct the light level change caused by a change in the optical intensity.

Figure 17:
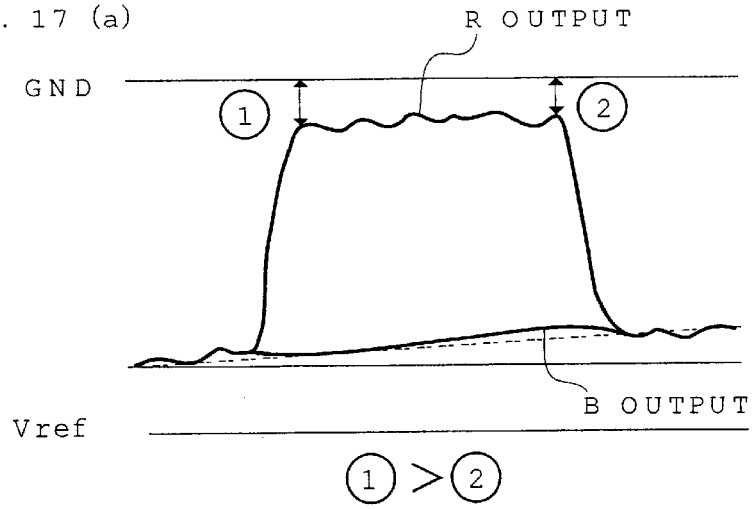
FIGS. 17(*a*), (*b*), and (*c*) are diagrams showing the signal processing of the pattern detector in the embodiment in FIG. 1.
Figure 17:
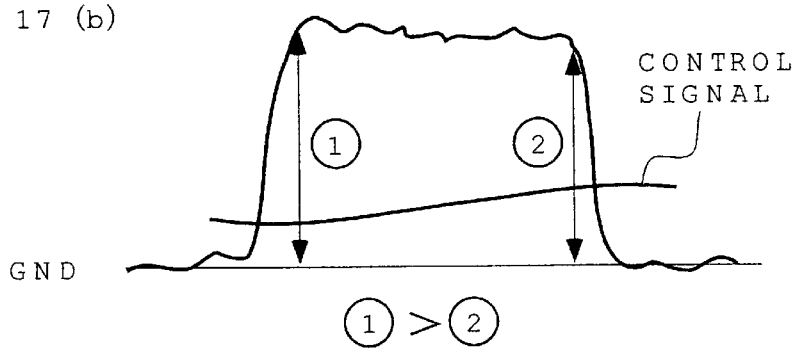
Figure 17:
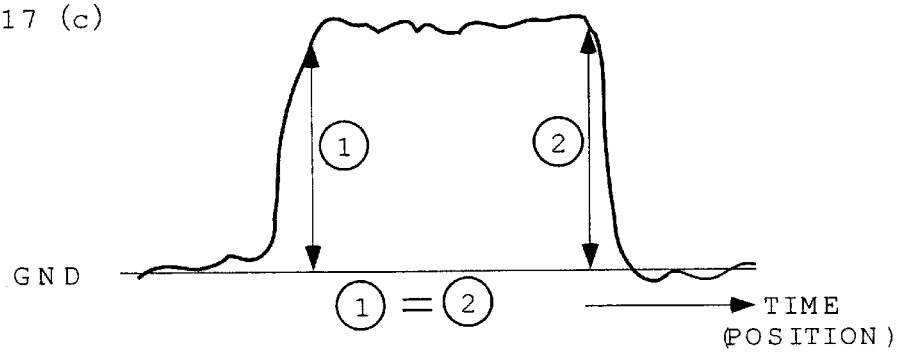
Figure 18:
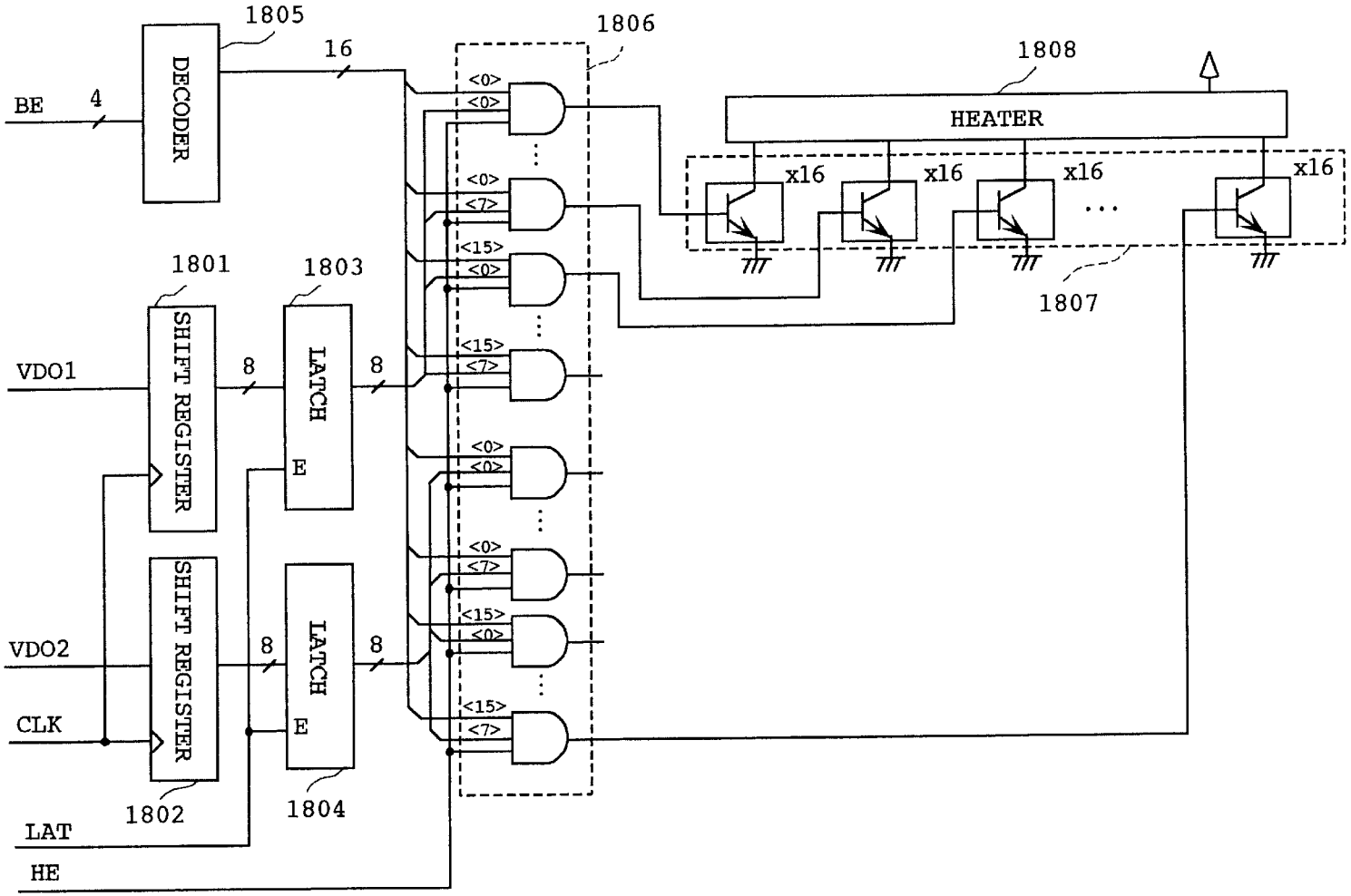
FIG. 18 is a diagram showing an internal circuit of a print head.
Figure 19:
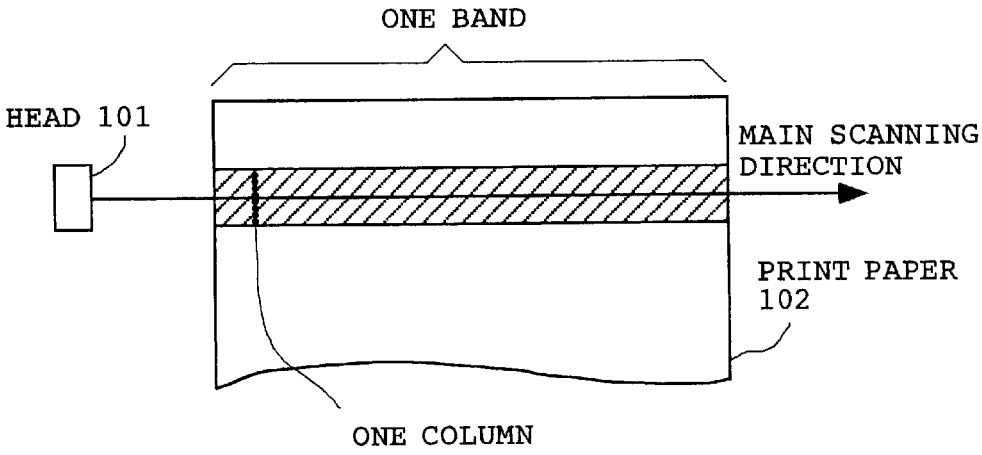
FIG. 19 is a diagram showing an example of printing of one band.
Figure 20:
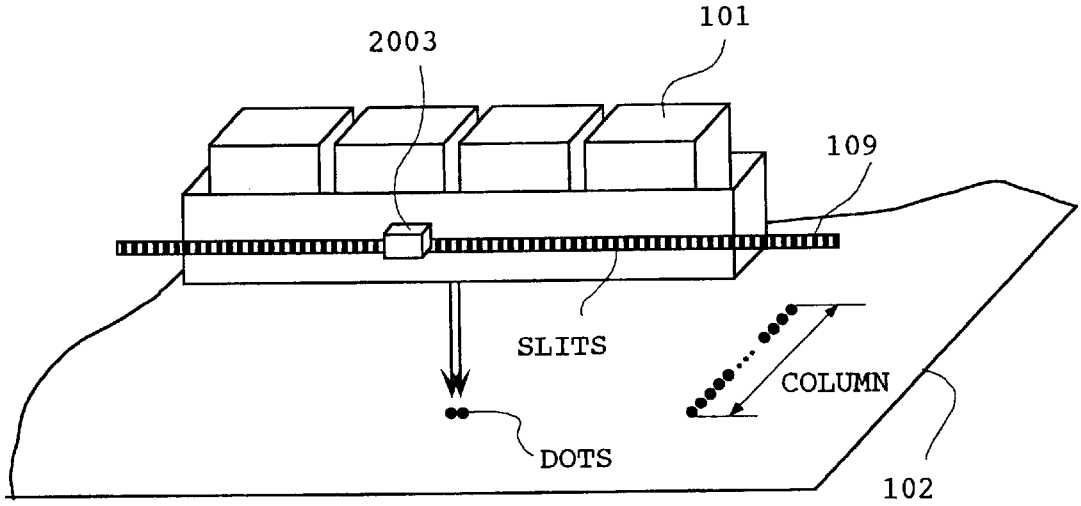
FIG. 20 is a diagram showing a linear scale configuration and a print timing.
Figure 21:
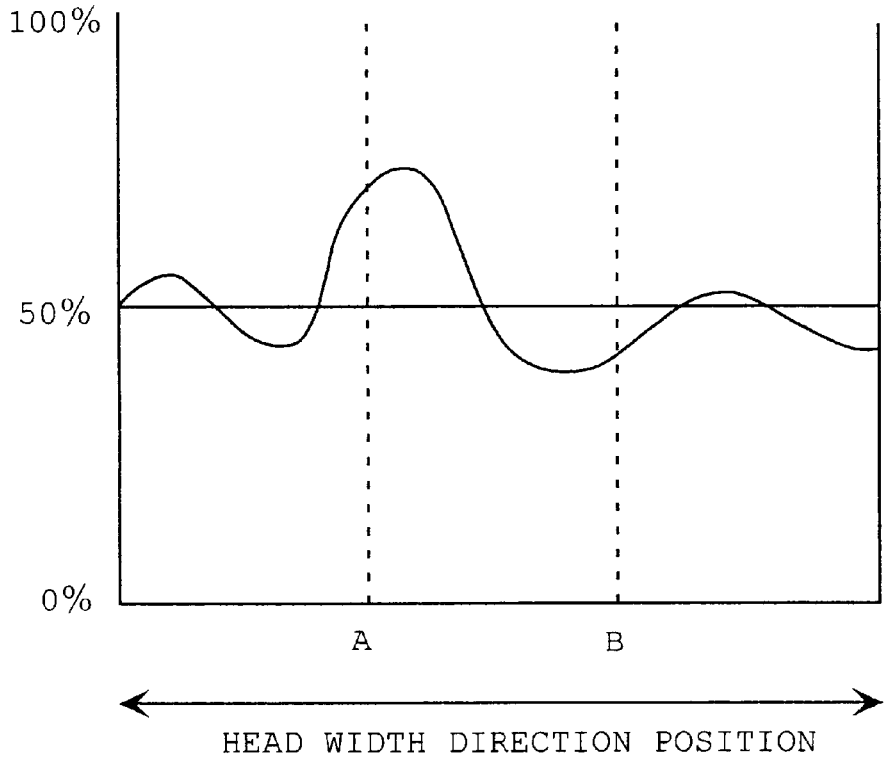
FIG. 21 is a diagram showing the relation between head nozzle positions and density.

FIGS. 17(*a*), (*b*), and (*c*) show the status of this level change correction. FIG. 17(*a*) shows the output status of the light receiving elements for the B and R lights and the reference level Vref used for subtracting the B light from the reference level Vref. The figure shows that the output level of the sensor decreases in the right part as the light intensity decreases because of the paper status. At this time, the reference level Vref is set at the negative level with respect to the output level of the light receiving element for the B light. FIG. 17(*b*) shows the result of the subtraction circuits 1104 and 1601. The output of the subtraction circuit 1104 is stable at the GND level in the position where there is no pattern (right and left ends in the figure) but the output level is decreased in the right part of the pattern. The figure also shows that the output of the subtraction circuit 1601 is high in the right part. FIG. 17(*c*) shows the result produced by amplifying the output of the subtraction circuit 1104 with the output 1602 of the subtraction circuit 1601 as the control signal. Because the amplification ratio of the right part of the pattern is high, the level in the right part and the level in the left part are the same.

Although only one circuit is shown in FIG. 16 to simplify the illustration, there are three circuits, one for each pattern color.

The operation described above is executed to read an auto head shading pattern to correctly detect a change in the density level in the nozzle column direction of a pattern recorded by each head even if a paper rise or a cockle occurs.

While the preferred forms of the invention have been described, it is to be understood that changes and variations may be made.

INDUSTRIAL APPLICABILITY

The present invention may be applied to the design and manufacturing of an image recording device such as an ink jet recording printer, plotter, and facsimile. According to the present invention, the light receiving elements, each of which receives one of R, G, and B lights, reads a predetermined print pattern printed by each head. The device uses the light receiving element for the complementary color of a pattern and the light receiving element for a non-complementary color and calculates the difference between the two outputs to detect the amount of density change amount. This method enables the device to correctly detect the density level of the pattern even if a rise or a cockle occurs on the print paper.

What is claimed is:

1. An image forming device using an ink jet recording method, said device forming a color image using a plurality of heads each of which has a plurality of ink ejection nozzles thereon, said device comprising:

means for printing a print pattern at a predetermined density using the plurality of ink ejection nozzles, one head at a time, on a print paper;

a reflective-type optical sensor which reads the print pattern in each color while scanning the print pattern in a nozzle column direction; and density calculating means for calculating a density of the print pattern in each color based on an output of said reflective-type optical sensor, wherein said reflective-type optical sensor comprises a light emitting element which emits a light including all lights in red/blue/green regions on an optical wavelength and a plurality of light receiving elements each of which detects a light in one of the red/blue/green regions on optical wavelength, and wherein, based on an output of the light receiving element for a complementary color light of each pattern color and an output of a light receiving element for a non-complementary color light of the pattern color, said destiny calculating means calculates a difference between the two outputs to detect a density level on a nozzle position basis for the print pattern printed by each-head.

2. The image forming device according to claim 1, wherein the print pattern is a band pattern recorded by all ink ejection nozzles of each head and having a width corresponding at least to a head width, wherein said plurality of light receiving elements are arranged in a main scanning direction, wherein said reflective-type optical sensor has a rectangular light transmission slit with longer sides aligned in the main scanning direction such that an image of the print pattern in a predetermined position is formed on receiving surfaces of said plurality of light receiving elements, and wherein said reflective-type optical sensor scans relatively in a sub-scanning direction with respect to the pattern.

3. The image forming device according to claim 1, wherein said density calculating means calculates the density level on a nozzle basis for each head.

4. The image forming device according to claim 3, further comprising means for adjusting the print density on a nozzle basis for each head according to the density level calculated on a nozzle basis for each head.

5. The image forming device according to claim 1, wherein said plurality of heads comprise a cyan head for ejecting cyan ink, a magenta head for ejecting magenta ink, and a yellow head for ejecting yellow ink, said device further comprising:

an A/D converter which converts an analog signal to a digital signal; and switching means for switching an input to said A/D converter such that a difference between an output of the light receiving element for detecting the red light and an output of the light receiving element for detecting the blue light or the green light is input to said A/D converter when said cyan head reads the pattern, such that a difference between the output of the light receiving element for detecting the green light and an output of the light receiving element for detecting the blue light or the red light is input to said A/D converter when said magenta head reads the pattern, and such that a difference between an output of the light receiving element for detecting the blue light and an output of the light receiving element for detecting the red light or the green light is input to said A/D converter when said yellow head reads the pattern.

6. The image forming device according to claim 1, further comprising a subtraction circuit which calculates a difference between an output of the light receiving element for the non-complementary color light and a predetermined reference level and an amplifier which amplifies the difference between the output of the light receiving element for the complementary color light and the output of the light receiving element for the non-complementary color light using an amplification factor according to the output of the subtraction circuit.

* * * * *